US012078032B2

(12) United States Patent
Doane et al.

(10) Patent No.: US 12,078,032 B2
(45) **Date of Patent: *Sep. 3, 2024**

(54) FULLY SHROUDED NOZZLE REMOVED BY SHEAR

(71) Applicants: James Doane, Friendswood, TX (US); Kyle Henagan, Spring, TX (US); Marc Samuelson, Houston, TX (US)

(72) Inventors: James Doane, Friendswood, TX (US); Kyle Henagan, Spring, TX (US); Marc Samuelson, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/668,268

(22) Filed: Feb. 9, 2022

(65) Prior Publication Data

US 2022/0268130 A1 Aug. 25, 2022

Related U.S. Application Data

(60) Provisional application No. 63/148,478, filed on Feb. 11, 2021.

(51) Int. Cl.
*E21B 41/00* (2006.01)
*E21B 17/06* (2006.01)

(52) U.S. Cl.
CPC ..... *E21B 41/0078* (2013.01); *E21B 17/06* (2013.01)

(58) Field of Classification Search
CPC ..... E21B 41/0078
See application file for complete search history.

(56) References Cited

U.S. PATENT DOCUMENTS 2,104,823 A * 1/1938 Sherman ..... E21B 10/18 175/340
2,682,389 A * 6/1954 Baker ..... E21B 10/18 175/340

(Continued)

FOREIGN PATENT DOCUMENTS

| | | | |
|---|---|---|---|
| CN | 204738801 | U | 11/2015 |
| EP | 0163590 | A1 | 4/1985 |
| WO | 2010077838 | A2 | 7/2010 |

OTHER PUBLICATIONS

International Search Report and Written Opinion Issued in International Application No. PCT/US2022/014854 mailed Apr. 27, 2022; 9 Pages.

(Continued)

*Primary Examiner* — Jonathan Malikasim
(74) *Attorney, Agent, or Firm* — CANTOR COLBURN LLP

(57) ABSTRACT

A downhole tool, a nozzle assembly for the downhole tool and a nozzle. The nozzle assembly includes an orifice in a housing of the downhole tool. The orifice has a housing groove. A nozzle is insertable into the orifice, the nozzle including a nozzle groove. A release member secures the nozzle to the housing by disposing a first portion of the release member in the housing groove and a second portion of the release member in the nozzle groove. The first portion is removable from the second portion upon applying a force to the nozzle above a release threshold. The nozzle includes a body having an outlet end, a nozzle groove on a surface of the body for receiving a release member to secure the nozzle within a housing, and a seal groove for isolating the nozzle groove from an environment at the outlet end.

18 Claims, 5 Drawing Sheets

(56) References Cited

U.S. PATENT DOCUMENTS

| | | | | |
|---|---|---|---|---|
| 3,129,777 | A | 4/1964 | Haspert | |
| 3,245,472 | A * | 4/1966 | Zandmer | E21B 43/11 166/100 |
| 3,922,009 | A * | 11/1975 | Giebeler | E21B 17/08 285/391 |
| 4,323,130 | A * | 4/1982 | Dennis | E21B 10/62 175/429 |
| 4,793,426 | A | 12/1988 | Millsapps, Jr. | |
| 5,526,884 | A | 6/1996 | Lembcke | |
| 5,906,245 | A | 5/1999 | Tibbitts et al. | |
| 6,192,999 | B1 | 2/2001 | Nguyen | |
| 6,227,316 | B1 | 5/2001 | Rohde | |
| 6,311,793 | B1 | 11/2001 | Larsen et al. | |
| 7,243,728 | B2 * | 7/2007 | Stoesz | E21B 34/14 166/242.6 |
| 7,735,582 | B2 * | 6/2010 | Smith | E21B 10/62 175/429 |
| 7,954,568 | B2 * | 6/2011 | Bilen | E21B 10/61 175/429 |
| 9,593,542 | B2 * | 3/2017 | Getzlaf | E21B 17/14 |
| 2006/0065395 | A1 * | 3/2006 | Snell | E21B 47/01 175/45 |
| 2009/0205870 | A1 | 8/2009 | Smith | |
| 2022/0228463 | A1 * | 7/2022 | Samuelson | E21B 34/06 |
| 2022/0243554 | A1 * | 8/2022 | Slup | E21B 43/26 |

OTHER PUBLICATIONS

International Search Report and Written Opinion Issued in International Application No. PCT/US2022/012758 mailed Apr. 29, 2022; 10 Pages.

* cited by examiner

FULLY SHROUDED NOZZLE REMOVED BY SHEAR

CROSS REFERENCE TO RELATED APPLICATIONS

This application claims the benefit of an earlier filing date from U.S. Provisional Application Ser. No. 63/148,478 filed Feb. 11, 2021, the entire disclosure of which is incorporated herein by reference.

BACKGROUND

In the resource recovery industry, downhole tools can be used in a wellbore for various reasons. A downhole tool can include a component which is manufactured to specifications that are based on an evaluation of the formation and/or fluids within the wellbore. In general, tool construction requires parts that are built to these specifications. When the evaluation changes, the tool must be disassembled and reassembled with the correct parts, costing manufacture time and cost. There is therefore a need to be able to change tool specifications without disassembly of the tool.

SUMMARY

In an aspect, a nozzle assembly for a downhole tool is disclosed herein. The nozzle assembly includes an orifice in a housing of the downhole tool, the orifice having a housing groove, a nozzle insertable into the orifice, the nozzle including a nozzle groove, and a release member having a first portion and a second portion, the release member securing the nozzle to the housing by disposing the first portion in the housing groove and the second portion in the nozzle groove; wherein the first portion is removable from the second portion upon applying a force to the nozzle above a release threshold.

In another aspect, a downhole tool is disclosed herein. The downhole tool includes a housing having an orifice formed therein, the orifice having a housing groove, a nozzle insertable into the orifice, the nozzle including a nozzle groove, and a release member having a first portion and a second portion, the release member securing the nozzle to the housing by having the first portion disposed in the housing groove and the second portion disposed in the nozzle groove; wherein the first portion is removable from the second portion upon applying a force to the nozzle above a release threshold.

In yet another aspect, a nozzle is disclosed herein. The nozzle includes a body having an outlet end, a nozzle groove on a surface of the body for receiving a release member to secure the nozzle within a housing, and a seal groove for isolating the nozzle groove from an environment at the outlet end.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
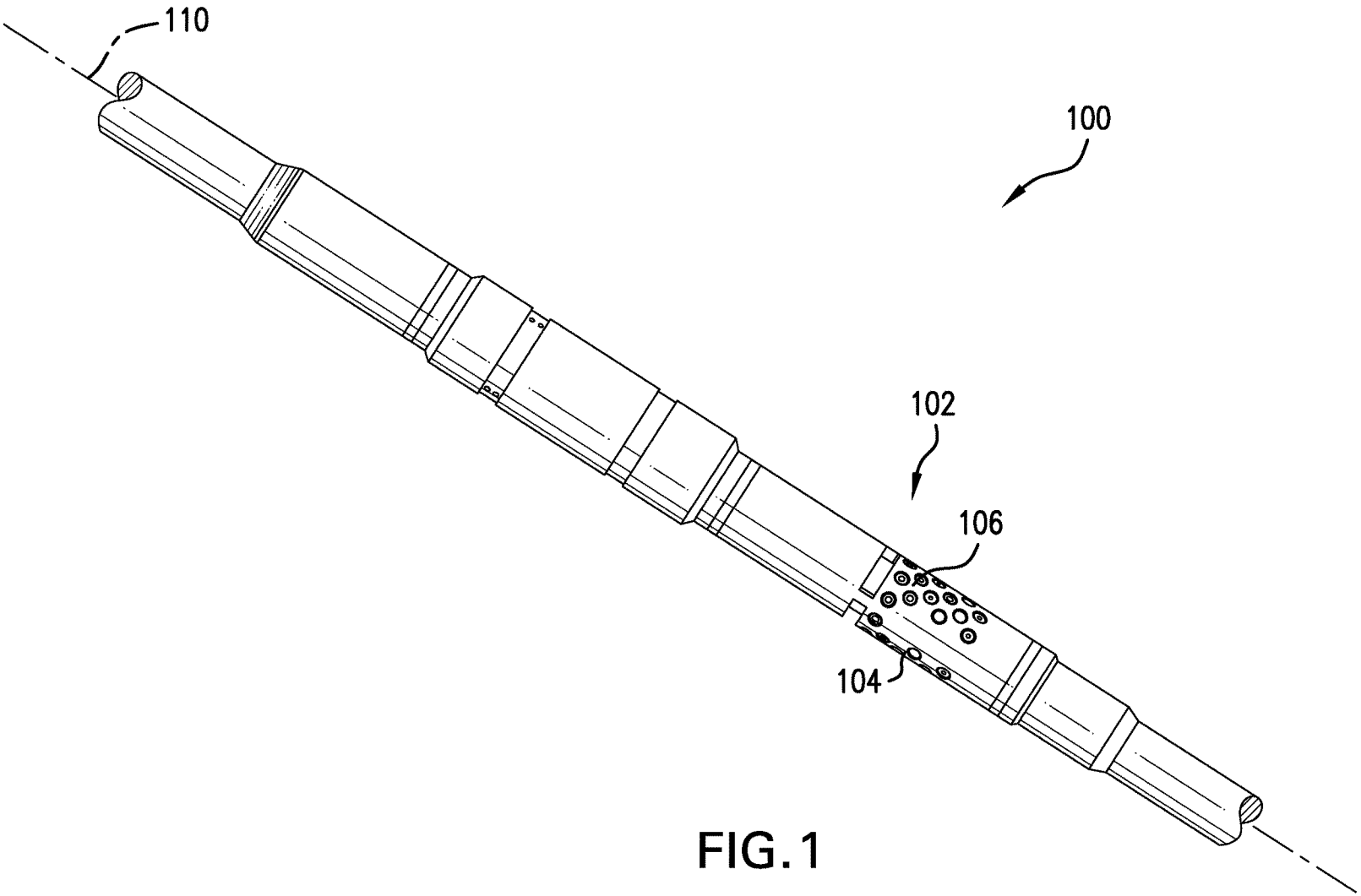
FIG. 1 shows a tool for use in a wellbore in an illustrative embodiment.

Referring to FIG. 1, a tool 100 for use downhole in a wellbore is disclosed. In various embodiments, the tool 100 can be used for drilling, production, completion, etc. The tool 100 can be a tubular member having a longitudinal axis 110. In the illustrative embodiment, the tool 100 includes a valve device 102 having a housing 104 and a plurality of nozzle assemblies 106 formed within the housing 104. The housing 104 extends along the longitudinal axis 110 of the tool 100. The plurality of nozzle assemblies 106 allow for flow of fluid through the housing 104 either from an exterior of the tool 100 to an interior of the tool 100 or from the interior to the exterior, depending on the use of the tool 100. In various embodiments, the tool 100 can be a drill bit.

Figure 2:
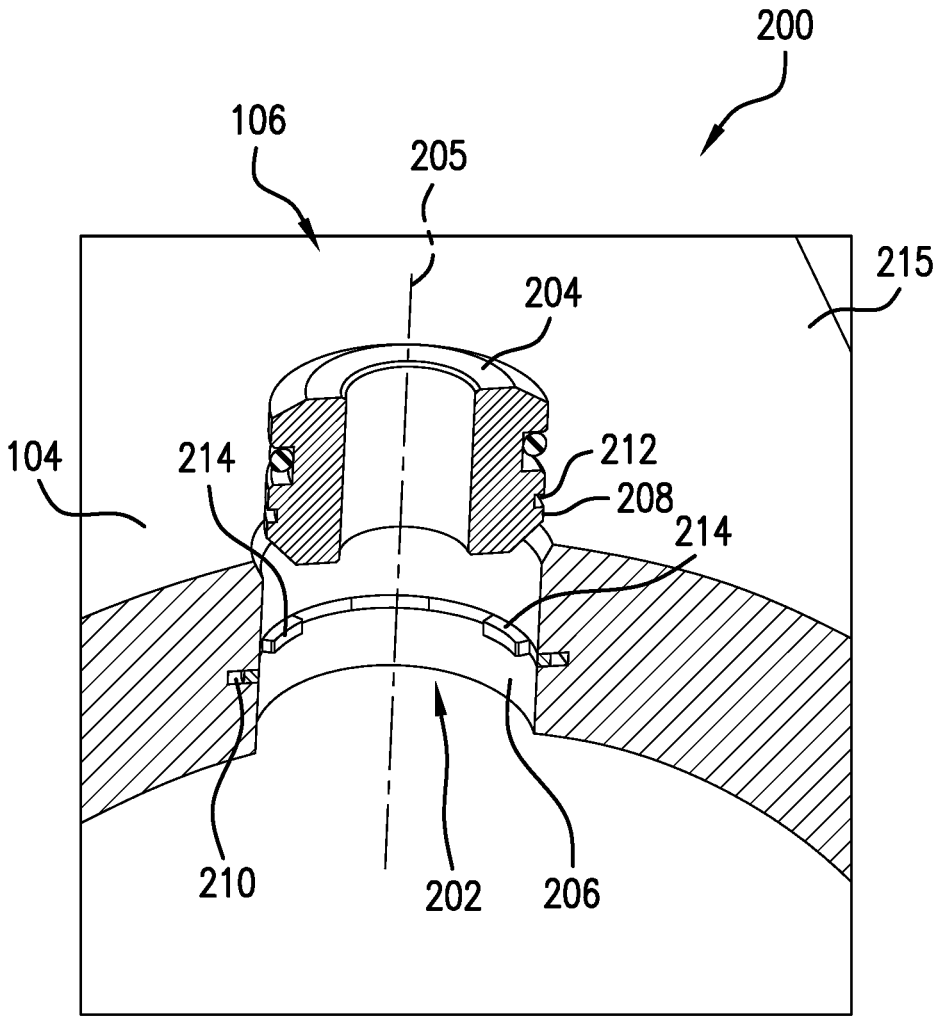
FIG. 2 shows a perspective view of a nozzle assembly.

FIG. 2 shows a perspective view 200 of a nozzle assembly 106. The nozzle assembly 106 includes a cavity, hole or orifice 202 formed in the housing 104 and a nozzle 204 that is insertable into the orifice 202. The housing 104 generally forms a cylindrical shell or opening. The orifice 202 and nozzle 204 are aligned along a nozzle assembly axis 205 that can be aligned along a radial line of the housing (i.e., a line perpendicular to longitudinal axis 110 of the housing 104). The orifice 202 forms a passage extending from an inner diameter of the cylindrical shell of the housing 104 to an outer diameter of the cylindrical shell, the passage allowing flow of fluid between an interior bore of the housing 104 and an exterior of the housing. In various embodiments the orifice 202 has an inner wall 206 centered on the nozzle assembly axis 205 and the nozzle 204 is a body having an outer surface 208 forming a surface of the nozzle 204. The body of the nozzle 204 and the shape of the orifice 202 can be any selected shape. In various embodiments, the body of the nozzle 204 is a cylindrical body and the shape of the orifice 202 is also cylindrical. The dimensions of the cylindrical body match the dimensions of the orifice 202. In other words, an outer diameter of the outer surface 208 is equal to or substantially equal to an inner diameter of the inner wall 206, to allow the nozzle 204 to fit snugly within the orifice 202.

A housing groove 210 is formed at the inner wall 206 of the orifice 202. The housing groove 210 extends circumferentially around the inner wall 206 and extends away from the nozzle assembly axis 205 into the housing 104. The housing groove 210 is located at a selected distance radially inward from an outer diameter surface 215 of the housing 104 in order to protect the housing groove 210 and anything in the housing groove 210 from the downhole environment such as erosion due to fluid flowing through the nozzle 204. The nozzle 204 includes a nozzle groove 212 formed circumferentially in the outer surface 208 of the nozzle 204. The nozzle groove 212 extends radially inward from the outer surface 208. The nozzle 204 is secured within the orifice 202 by a release member 214 that is disposed in both the housing groove 210 and the nozzle groove 212. The location of the housing groove 210 in the housing 104 (i.e., away from the outer diameter surface 215) therefore protects the release member 214 from the downhole environment when the tool 100 is downhole.

Figure 3A:
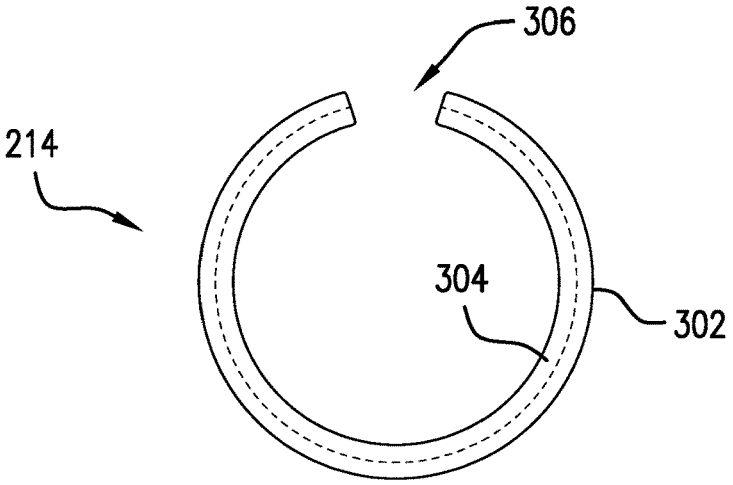
FIGS. 3A-3C shows a top view of a release member f the nozzle assembly in various embodiments.
Figure 3B:
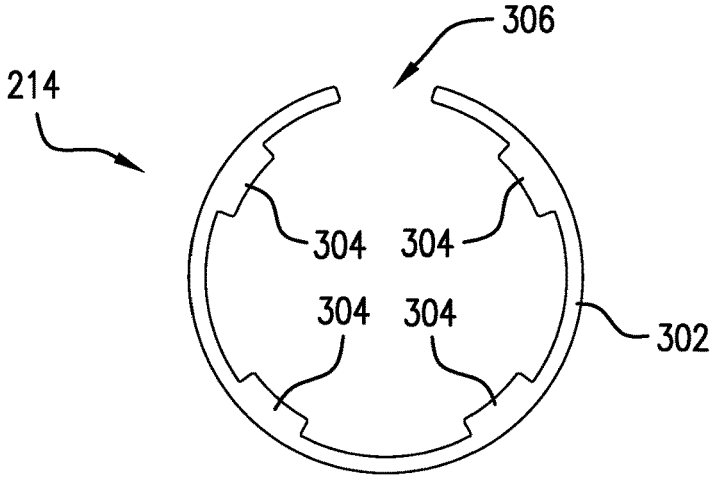
Figure 3C:
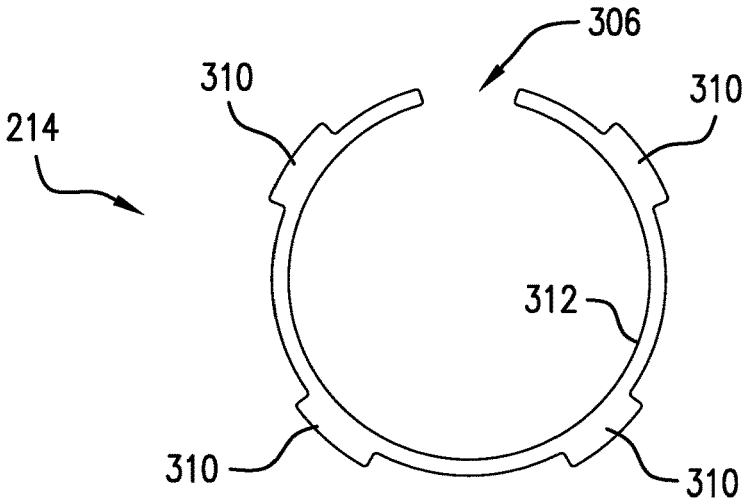

FIGS. 3A-3C shows a top view of the release member 214 in various embodiments. FIG. 3A shows an embodiment of the release member 214 with a retainer ring having a first portion (i.e., outer ring portion 302) and second portion (i.e., inner ring portion 304). The dimensions of the release member 214 are such that, when the release member 214 is in a radially relaxed state, the outer ring portion 30:2 resides in the housing groove 210 and the inner ring portion 304 resides in the nozzle groove 212. The release member 214 forms a semi-ring (or a ring with a gap 306 at an azimuth location along its circumference). Both the outer ring portion 302 and the inner ring portion 304 are solid along the circumference except at the gap 306.

FIG. 3B shows an embodiment of the release member 214 including radially inward tabs. The release member 214 is a retainer ring including a first portion (i.e., outer ring portion 302) and a second portion (i.e., tabs 304) protruding radially inward from the outer ring portion 302. The outer ring portion 302 forms a semi-ring (or a ring with a gap 306 at an azimuth location along its circumference). In an embodiment, the protrusions or tabs 304 are equally spaced about the inner surface of the outer ring portion 302. While shown with four tabs 304 for illustrative purposes, the retainer ring can have any number of tabs protruding from the inner surface of the outer ring portion, in various embodiments.

FIG. 3C shows an embodiment of the release member 214 including radially outward tabs. The release member 214 is a retainer ring including a first portion (i.e., tabs 310) and a second portion (i.e., inner ring portion 312), with the tabs 310 protruding radially outward from the inner ring portion 312. The inner ring portion 312 forms a semi-ring (or a ring with a gap 306 at an azimuth location along its circumference). In an embodiment, the protrusions or tabs 310 are equally spaced about the outer surface of the inner ring portion 312. While shown with four tabs 310 for illustrative purposes, the retainer ring can have any number of tabs protruding from the outer surface of the inner ring portion 312, in various embodiments.

Referring back to FIG. 2, a method of securing the nozzle 204 within the orifice 202 using the release member 214 is now discussed. The method is discussed with respect to using the release member 214 of FIG. 3B for illustrative purposes only. The release members shown in FIGS. 3A and 3C can secure the nozzle 204 within the orifice 202 using the same or similar method. To secure the nozzle 204 within the orifice 202, the release member 214 is placed within the housing groove 210 of the orifice 202. The release member 214 is lowered into the orifice 202 in a slightly radially compressed state. The gap 306 can be reduced to allow the release member 214 to compress. When the release member 214 reaches the housing groove 210, it expands into the housing 104 so that the outer ring portion 302 is within the housing groove 210 and the tabs 304 are outside the housing groove 210, extending radially inward. The housing groove 210 has a depth that allows the release member 214 to expand radially outward. Once the release member 214 is in place within the housing groove 210, the nozzle 204 is lowered into the orifice 202. As the nozzle 204 is lowered into the orifice 202, a tapered inlet end of the nozzle 204 pushes the tabs 304 radially outward to expand the release member 214 outward into the housing groove 210. When the nozzle groove 212 becomes axially aligned with the housing groove 210, the release member 214 contracts to a radially relaxed state in which the outer ring portion 302 is within the housing groove 210 and the tabs 304 are within the nozzle groove 212, thereby securing the nozzle 204 in the orifice 202.

Figure 4:
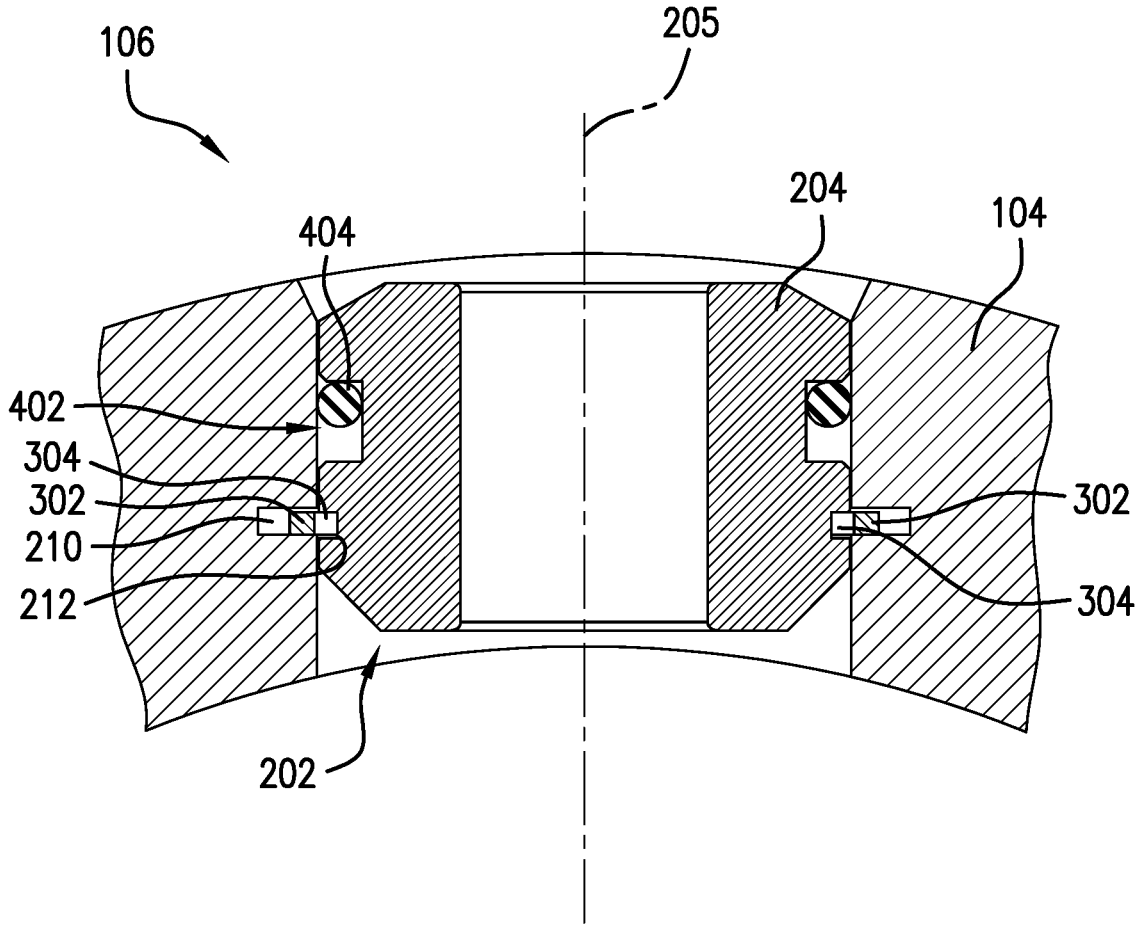
FIG. 4 shows a side cross-sectional view of the nozzle assembly with the nozzle installed in the orifice.

FIG. 4 shows a side cross-sectional view 400 of the nozzle assembly with the nozzle 204 installed in the orifice 202. The release member 214 is disposed with its outer ring portion 302 within the housing groove 210 and the tabs 304 extending into the nozzle groove 212. The nozzle 204 includes a seal groove 402 axially located between an outlet end of the nozzle and the nozzle groove 212. An O-ring 404 located in the seal groove 40:2 seals any gap between the nozzle 204 and inner wall 206, thereby prevent a flow of fluid through the gap between outer surface 208 of the nozzle 204 and the inner wall 206 of the orifice 202, thereby preventing erosion of the release member 214.

Figure 5:
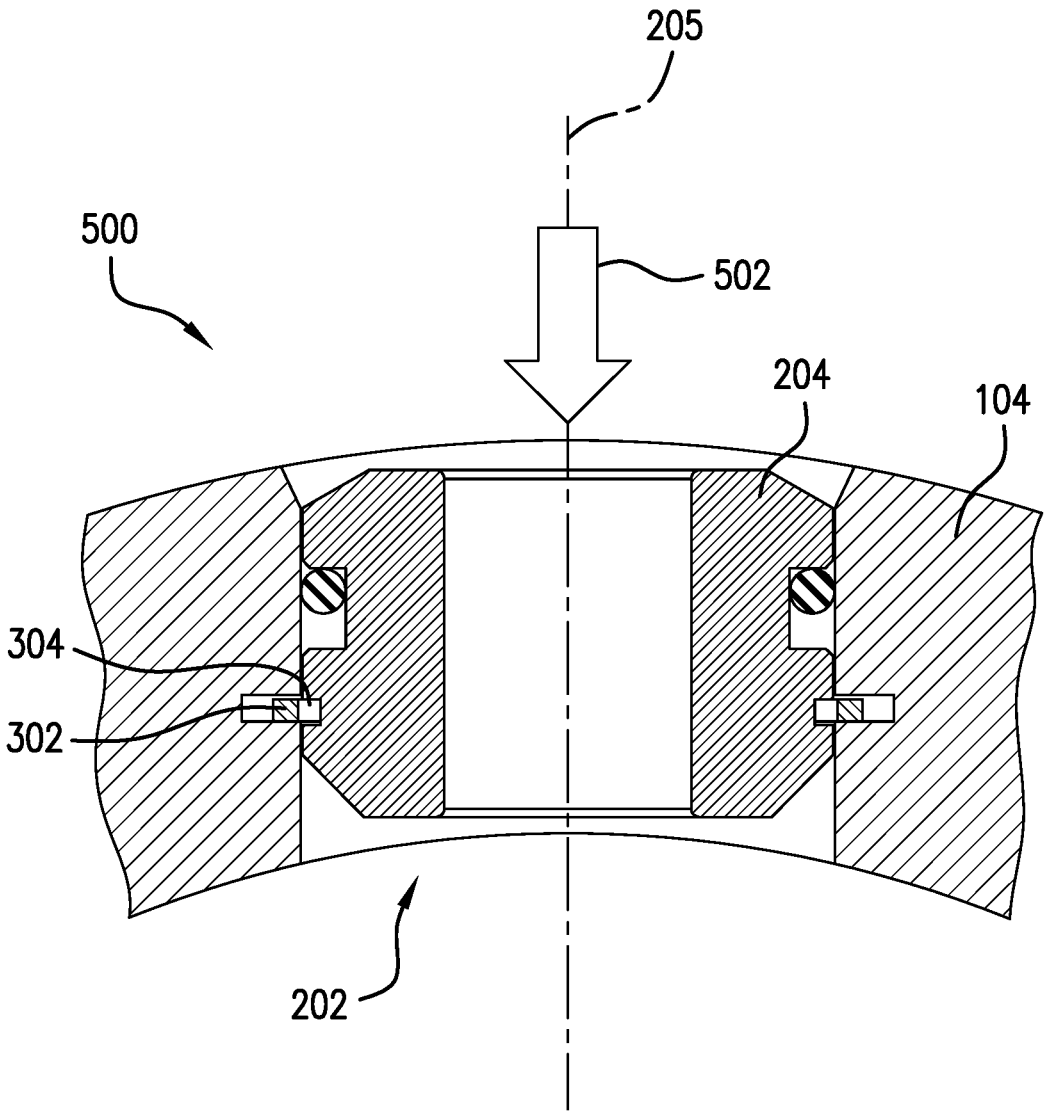
FIG. 5 illustrates an action for removing the nozzle from the orifice.

FIG. 5 illustrates an action 500 for removing the nozzle 204 from the orifice 202. A three or load 502 is applied to the nozzle 204 along the nozzle assembly axis 205. The load 502 applies a shear force at the release member 214 by forcing the tabs 304 in one direction along the nozzle assembly axis 205 while the outer ring portion 302 is maintained at its location in the housing groove 210. When a magnitude of the load 502 is above a release threshold of the release member 214, the tabs 304 separate from the outer ring portion 302, thereby freeing the nozzle 204 from the housing 104 and allowing the nozzle 204 to be removed from the housing 104.

While the tool is discussed herein as securing a nozzle within an orifice using a release member to form a nozzle assembly, the release member can be used to secure any suitable device or member within the housing or within a tool.

Set forth below are some embodiments of the foregoing disclosure:

Embodiment 1: A nozzle assembly for a downhole tool. The nozzle assembly includes an orifice in a housing of the downhole tool, the orifice having a housing groove, a nozzle insertable into the orifice, the nozzle including a nozzle groove, and a release member having a first portion and a second portion, the release member securing the nozzle to the housing by disposing the first portion in the housing groove and the second portion in the nozzle groove. The first portion is removable from the second portion upon applying a force to the nozzle above a release threshold.

Embodiment 2. The nozzle assembly of any prior embodiment, wherein the orifice includes a cylindrical inner wall and the nozzle comprises a cylindrical body, wherein an outer diameter of the cylindrical body is substantially equal to an inner diameter of the inner wall.

Embodiment 3. The nozzle assembly of any prior embodiment, wherein the nozzle groove extends circumferentially around an outer surface of the cylindrical body and the housing groove extends circumferentially around the inner wall of the orifice.

Embodiment 4. The nozzle assembly of any prior embodiment, wherein applying the force to the nozzle above the release threshold detaches the nozzle from the housing.

Embodiment 5. The nozzle assembly of any prior embodiment, wherein the release member is a retainer ring, the first portion is an outer ring portion including a gap along its circumference and the second portion includes a tab extending radially inward from the outer ring portion.

Embodiment 6. The nozzle assembly of any prior embodiment, wherein the release member is one of: (i) a garter spring; and (ii) an O-ring.

Embodiment 7. The nozzle assembly of any prior embodiment, wherein the housing groove is at a location radially inward from an outer surface of the downhole tool to protect the release member from a downhole environment.

Embodiment 8. A downhole tool. The downhole tool includes a housing having an orifice formed therein, the orifice having a housing groove, a nozzle insertable into the orifice, the nozzle including a nozzle groove, and a release member having a first portion and a second portion, the release member securing the nozzle to the housing by having the first portion disposed in the housing groove and the second portion disposed in the nozzle groove. The first portion is removable from the second portion upon applying a force to the nozzle above a release threshold.

Embodiment 9. The downhole tool of any prior embodiment, wherein the orifice includes a cylindrical inner wall and the nozzle comprises a cylindrical body, wherein an outer diameter of the cylindrical body is substantially equal to an inner diameter of the inner wall.

Embodiment 10. The downhole tool of any prior embodiment, wherein the nozzle groove extends circumferentially around an outer surface of the cylindrical body and the housing groove extends circumferentially around the inner wall of the orifice.

Embodiment 11. The downhole tool of any prior embodiment, wherein applying the force to the nozzle above the release threshold detaches the nozzle from the housing.

Embodiment 12. The downhole tool of any prior embodiment, wherein the release member is a retainer ring, the first portion is an outer ring portion including a gap along its circumference and the second portion includes a tab extending radially inward from the outer ring portion.

Embodiment 13. The downhole tool of any prior embodiment, wherein the release member is one of: (i) a garter spring; and (ii) an O-ring.

Embodiment 14. The downhole tool of any prior embodiment, wherein the housing groove is at a location radially inward from an outer surface of the downhole tool to protect the release member from a downhole environment.

Embodiment 15. The downhole tool of any prior embodiment, wherein the downhole tool is one of: (i) a valve; (ii) a drill bit; and (iii) a sleeve.

Embodiment 16. A nozzle. The nozzle includes a body having an outlet end, a nozzle groove on a surface of the body for receiving a release member to secure the nozzle within a housing, and a seal groove for preventing flow between the body and the housing.

Embodiment 17. The nozzle of any prior embodiment, further comprising an O-ring disposed in the seal groove to form a seal between the nozzle and the housing to isolate the nozzle groove from the outlet end.

Embodiment 18. The nozzle of any prior embodiment, wherein the body is cylindrical and nozzle groove and seal groove extend circumferentially around the surface of the body.

Embodiment 19. The nozzle of any prior embodiment, wherein a longitudinal force applied above the release threshold of the release member allows the nozzle to be removed from the housing.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A nozzle assembly for a downhole tool, comprising an orifice in a housing of the downhole tool, the orifice having a housing groove;

a nozzle insertable into the orifice, the nozzle including a nozzle groove; and a release member having a first portion and a second portion, the release member securing the nozzle to the housing by disposing the first portion in the housing groove and the second portion in the nozzle groove;

wherein the first portion separates from the second portion when a force is applied to the nozzle above a release threshold, the force being applied radially inward along a radial line of the downhole tool.

2. The nozzle assembly of claim 1, wherein the orifice includes a cylindrical inner wall and the nozzle comprises a cylindrical body, wherein an outer diameter of the cylindrical body is substantially equal to an inner diameter of the inner wall.

3. The nozzle assembly of claim 2, wherein the nozzle groove extends circumferentially around an outer surface of the cylindrical body and the housing groove extends circumferentially around the inner wall of the orifice.

4. The nozzle assembly of claim 1, wherein applying the force to the nozzle above the release threshold with the first portion of the release member in the housing groove and the second portion in the nozzle groove separates the first portion from the second portion.

5. The nozzle assembly of claim 4, wherein the release member is a retainer ring, the first portion is an outer ring portion including a gap along its circumference and the second portion includes a tab extending radially inward from the outer ring portion.

6. The nozzle assembly of claim 4, wherein the release member is one of: (i) a garter spring; and (ii) an O-ring.

7. The nozzle assembly of claim 1, wherein the housing groove is at a location radially inward from an outer surface of the downhole tool to protect the release member from a downhole environment.

8. A downhole tool, comprising:

a housing having an orifice formed therein, the orifice having a housing groove;

a nozzle insertable into the orifice, the nozzle including a nozzle groove; and a release member having a first portion and a second portion, the release member securing the nozzle to the housing by having the first portion disposed in the housing groove and the second portion disposed in the nozzle groove;

wherein the first portion separates from the second portion when a force is applied to the nozzle above a release threshold the force being applied radially inward along a radial line of the downhole tool.

9. The downhole tool of claim 8, wherein the orifice includes a cylindrical inner wall and the nozzle comprises a cylindrical body, wherein an outer diameter of the cylindrical body is substantially equal to an inner diameter of the inner wall.

10. The downhole tool of claim 9, wherein the nozzle groove extends circumferentially around an outer surface of the cylindrical body and the housing groove extends circumferentially around the inner wall of the orifice.

11. The downhole tool of claim 8, wherein applying the force to the nozzle above the release threshold with the first portion of the release member in the housing groove and the second portion in the nozzle groove separates the first portion from the second portion.

12. The downhole tool of claim 11, wherein the release member is a retainer ring, the first portion is an outer ring portion including a gap along its circumference and the second portion includes a tab extending radially inward from the outer ring portion.

13. The downhole tool of claim 11, wherein the release member is one of: (i) a garter spring; and (ii) an O-ring.

14. The downhole tool of claim 8, wherein the housing groove is at a location radially inward from an outer surface of the downhole tool to protect the release member from a downhole environment.

15. The downhole tool of claim 8, wherein the downhole tool is one of: (i) a valve; (ii) a drill bit; and (iii) a sleeve.

16. A nozzle, comprising:

a body having an outlet end, the body configured to fit within an orifice in a tubular housing, the orifice aligned along a radial line of the housing;

a nozzle groove on a surface of the body for receiving a release member to secure the nozzle within the orifice of the tubular housing, wherein a force applied on the body in a radially inward direction along the radial line ruptures the release member; and a seal groove located between an outer end of the nozzle and the nozzle groove, wherein an O-ring disposed in the seal groove forms a seal between the body and the housing to prevent flow between the body and the housing.

17. The nozzle of claim 16, wherein the body is cylindrical and the nozzle groove and seal groove extend circumferentially around the surface of the body.

18. The nozzle of claim 16, wherein a longitudinal force applied above the release threshold of the release member separates a first portion of the release member from a second portion of the release member to allow the nozzle to be removed from the housing.

* * * * *